US008953974B2

(12) United States Patent
Manabe

(10) Patent No.: US 8,953,974 B2
(45) Date of Patent: Feb. 10, 2015

(54) IMAGE FORMING APPARATUS

(71) Applicant: Canon Kabushiki Kaisha, Tokyo (JP)

(72) Inventor: Kenichi Manabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 77 days.

(21) Appl. No.: 13/709,590

(22) Filed: Dec. 10, 2012

(65) Prior Publication Data

US 2013/0223873 A1 Aug. 29, 2013

(30) Foreign Application Priority Data

Feb. 27, 2012 (JP) ..... 2012-040572

(51) Int. Cl.

| | |
|---|---|
| ***G03G 15/08*** | (2006.01) |
| ***G03G 21/10*** | (2006.01) |
| *G03G 21/00* | (2006.01) |
| *G03G 21/18* | (2006.01) |

(52) U.S. Cl.

CPC ..... *G03G 15/0865* (2013.01); *G03G 15/0844* (2013.01); *G03G 21/105* (2013.01); *G03G 2221/1648* (2013.01); *G03G 21/007* (2013.01); *G03G 21/1832* (2013.01); *G03G 21/0011* (2013.01); *G03G 15/0817* (2013.01)

USPC ..... 399/102; 399/103; 399/105; 399/106; 399/358

(58) Field of Classification Search

CPC ..... G03G 21/00

USPC ..... 399/102–103, 105–106, 358

See application file for complete search history.

(56) References Cited

U.S. PATENT DOCUMENTS

| | | | | |
|---|---|---|---|---|
| 5,617,195 | A * | 4/1997 | Torimaru et al. | 399/27 |
| 6,937,838 | B2 * | 8/2005 | Ishii et al. | 399/358 |
| 7,937,036 | B2 * | 5/2011 | Tanaka et al. | 399/358 |
| 8,315,548 | B2 * | 11/2012 | Gayne et al. | 399/358 |
| 8,838,006 | B2 * | 9/2014 | Kitamura | 399/358 |
| 2002/0064392 | A1 * | 5/2002 | Miura et al. | 399/103 |
| 2003/0108365 | A1 * | 6/2003 | Kabai | 399/297 |
| 2006/0216083 | A1 * | 9/2006 | Okoshi | 399/350 |
| 2013/0071165 | A1 * | 3/2013 | Kitamura | 399/358 |
| 2013/0223873 | A1 * | 8/2013 | Manabe | 399/102 |
| 2014/0010579 | A1 * | 1/2014 | Yoshino et al. | 399/358 |
| 2014/0044465 | A1 * | 2/2014 | Mekada | 399/358 |
| 2014/0056628 | A1 * | 2/2014 | Sato | 399/358 |

FOREIGN PATENT DOCUMENTS

| | | | | |
|---|---|---|---|---|
| JP | 2005-156699 | * | 6/2005 | G03G 15/08 |
| JP | 2005156699 | A | 6/2005 | |
| JP | 4457650 | B2 | 4/2010 | |

* cited by examiner

*Primary Examiner* — Clayton E Laballe
*Assistant Examiner* — Kevin Butler
(74) *Attorney, Agent, or Firm* — Fitzpatrick, Cella, Harper & Scinto

(57) ABSTRACT

An image forming apparatus comprising: an upstream side unit which discharges a conveyed developer from a discharge port; a downstream side unit which receives the developer discharged from the discharge port from a receiving port located at a position opposite to the discharge port; and a sealing member which includes a multiple layer with an elastic member and a sheet material alternately stacked and is nipped between the upstream side unit and the downstream side unit to seal a periphery of the discharge port and the receiving port, wherein at least one of the upstream side unit and the downstream side unit is detachably attachable to an apparatus body.

12 Claims, 10 Drawing Sheets

IMAGE FORMING APPARATUS

This application claims the benefit of Japanese Patent Application No. 2012-040572, filed Feb. 27, 2012, which is hereby incorporated by reference herein in its entirety.

BACKGROUND OF THE INVENTION

1. Field of the Invention

The present invention relates to an image forming apparatus including a toner recovering mechanism, such as a printer, a copier, or a facsimile.

2. Description of the Related Art

In an image forming apparatus based on an electrophotographic system, toner is delivered between units such as a toner container, a hopper container, a development device, a drum cartridge, and a recovery toner container. Here, the delivery of toner to the recovery toner container will be described as an example.

A residual transfer toner is removed and discharged by a cleaning portion from an electrophotographic photosensitive body or an intermediate transfer member after image formation. On the other hand, as for two-component developers in the development device, old developers are gradually discharged in order to prevent charging performance degradation.

The residual transfer toner or the discharged two-component developers are conveyed by a toner conveying mechanism to a discharge port and then are recovered through the discharge port into the recovery toner container. When a toner recovery amount in the recovery toner container reaches a predetermined amount, the recovery toner container is replaced with a new empty recovery toner container.

The recovered toner may leak through a gap in a connection portion between the discharge port and a recovering port of the recovery toner container. In order to prevent such leakage, the following technique is suggested (see Japanese Patent Laid-Open No. 2005-156699).

In Japanese Patent Laid-Open No. 2005-156699, a foam material (sponge) is provided at a discharge port or a recovering port of a recovery toner container, and the foam material is sandwiched and crumpled between the discharge port and the recovering port of the recovery toner container to seal a gap therebetween. This prevents leakage of the recovered toner.

However, when the recovery toner container disclosed in Japanese Patent Laid-Open No. 2005-156699 is moved in a direction perpendicular to a sponge compression direction as illustrated in FIG. 9A, a surface of the sponge being the connection portion between the discharge port and the recovering port is compressed. Therefore, the recovering port may not be sealed by wrinkling or curling of the sponge. In this case, the toner leaks from the gap between the discharge port and the recovering port.

Here, if the recovery toner container is moved in the sponge compression direction as described in FIG. 9B of Japanese Patent Laid-Open No. 2005-156699, wrinkling and curling of the sponge can be suppressed. However, the recovery toner container increases in size in a vertical direction of the image forming apparatus. Also, it is required to provide a complex mechanism such as a pressing mechanism or a holding mechanism for preventing the recovery toner container from falling by gravity.

It is desirable to suppress a deformation of a sealing member in unit attachment/detachment with a simple configuration and to prevent leakage of toner in a toner delivering portion.

SUMMARY OF THE INVENTION

In order to solve the above-mentioned problems, an image forming apparatus of the present invention includes: An image forming apparatus comprising: an upstream side unit which discharges a conveyed developer from a discharge port; a downstream side unit which receives the developer discharged from the discharge port from a receiving port located at a position opposite to the discharge port; and a sealing member which includes a multiple layer with an elastic member and a sheet material alternately stacked and is nipped between the upstream side unit and the downstream side unit to seal a periphery of the discharge port and the receiving port, wherein at least one of the upstream side unit and the downstream side unit is detachably attachable to an apparatus body.

Further features of the present invention will become apparent from the following description of exemplary embodiments with reference to the attached drawings.

DESCRIPTION OF THE EMBODIMENTS

Hereinafter, embodiments of the present invention will be described as examples. However, the dimensions, materials, shapes and relative arrangement of component parts described in the following embodiments may be modified appropriately according to the configurations or various conditions of an apparatus to which the present invention is applied. Therefore, unless specifically described, the scope of the present invention is not intended to be limited thereto.

First Embodiment

Overall Configuration of Image Forming Apparatus

Figure 1:
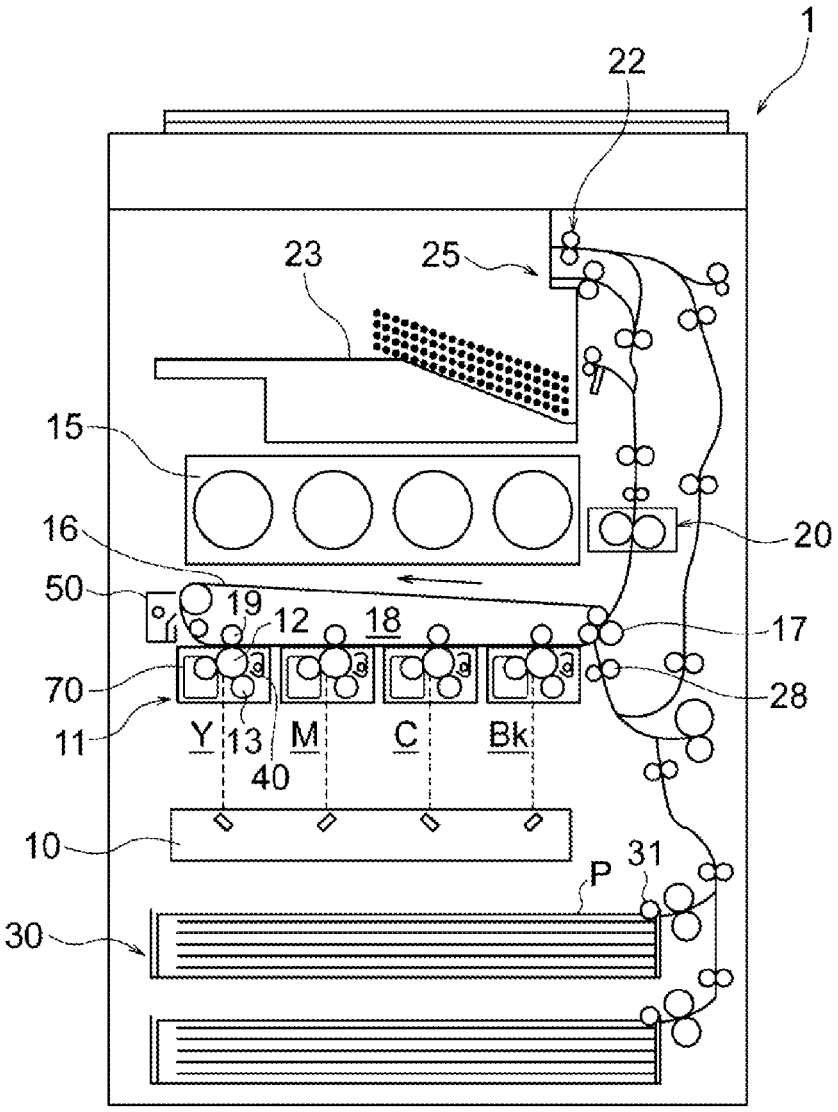
FIG. 1 is a cross-sectional view illustrating a schematic configuration of an image forming apparatus.

FIG. 1 is a cross-sectional view illustrating a schematic configuration of an image forming apparatus. In FIG. 1, a copying machine is described as an example of an image forming apparatus 1.

The image forming apparatus 1 includes a plurality of image forming portions 11 (process cartridges). The respective image forming portions 11 form, for example, toner images of respective colors of yellow (Y), magenta (M), cyan (C), and black (Bk). In FIG. 1, since the four image forming portions 11 have the same configuration, only the yellow (Y) image forming portion 11 is denoted with a reference numeral. Also, in the following description, the signs "Y, M, C and K" representing the respective colors will be omitted unless specifically required.

The image forming portion 11 is unitized, and is configured to be detachably attachable to a body of the image forming apparatus 1. The image forming portion 11 includes a photosensitive drum 12 (image bearing member) of an electrophotographic photosensitive body. A primary charger 13, a developing portion 70, and a drum cleaner 40 are arranged around the photosensitive drum 12. Also, an exposing apparatus 10 is disposed under all the photosensitive drums 12. The exposing apparatus 10 includes polygon mirrors and irradiates laser light.

Also, an intermediate transfer belt 16 (intermediate transfer member) is disposed over all the image forming portions 11 such that the intermediate transfer belt 16 abuts all the photosensitive drums 12. The intermediate transfer belt 16 extends around a plurality of rollers to form an intermediate transfer belt unit 18.

By the above schematic configuration, image formation is performed as follows.

A yellow image signal is transmitted from the outside to the image forming apparatus 1. Then, an electrostatic latent image corresponding to the yellow image signal is formed on the photosensitive drum 12 that is uniformly charged by the primary charger 13. The electrostatic latent image is formed by the laser light irradiated through the polygon mirrors inside the exposing apparatus 10. Thereafter, a yellow toner is supplied from the developing portion 70 to the electrostatic latent image. Accordingly, a yellow toner image is developed and visualized on the photosensitive drum 12 corresponding to yellow.

By the rotation of the photosensitive drum 12, the yellow toner image reaches a primary transfer region at which the photosensitive drum 12 and the intermediate transfer belt 16 abut each other. Here, a primary transfer bias is applied to a primary transfer member 19, so that the yellow toner image on the photosensitive drum 12 is transferred to the intermediate transfer belt 16 (primary transfer).

A region of the intermediate transfer belt 16, which bears the yellow toner image, moves onto the photosensitive drum 12 of the adjacent image forming portion (magenta process cartridge in this embodiment). Then, by that time, a magenta toner image has been formed on the photosensitive drum 12 corresponding to magenta through the same process as for the development of the yellow toner image described above. Therefore, the magenta toner image is superimposed and transferred on the yellow toner image.

Likewise, by the movement of the intermediate transfer belt 16, a cyan toner image and a black toner image in the primary transfer regions of the respective image forming portions are sequentially superimposed and transferred on the above-described yellow toner image and magenta toner image.

On the other hand, a recording material P is stored in a cassette 30. The recording material P is fed one by one from the cassette 30 by a pickup roller 31. The fed recording material P is time-synchronized with image formation timing in a registration roller 28. Thereafter, the recording material P reaches a secondary transfer region that is nipped between the intermediate transfer belt 16 and a secondary transfer roller 17. Herein, by a secondary transfer bias applied to the secondary transfer roller 17 (secondary transfer portion), four-color toner images on the intermediate transfer belt 16 are transferred in a lump onto the recording material P (secondary transfer).

The recording material P, onto which the four-color toner images have been transferred, is guided by a conveying guide, is conveyed to a fixing device 20 (fixing portion) disposed over the secondary transfer roller 17, and is subjected to heat and pressure in the fixing device 20. Accordingly, the respective color toners are melted and color-mixed, so that a full-color toner image is fixed onto the recording material P.

Thereafter, the recording material P, onto which the toner image has been fixed, is guided by the conveying guide, and is discharged onto a discharge tray 23 by discharge rollers 25 (discharge member) that are provided at a plurality of positions downstream in a recording material conveying direction of the fixing device 20.

In a single-side mode performing image formation on one side of the recording material P, the recording material P, on one side of which an image has been formed as described above, is discharged onto the discharge tray 23 by the discharge rollers 25.

On the other hand, in a duplex mode performing image formation on both sides of the recording material P, the recording material P, on one side of which an image has been formed as described above, is reversed through a duplex path and then conveyed to a registration roller 22. Thereafter, rear-side recording is completed through the same image forming process as for the front-side recording, and the recording material P, on the front and rear sides of which images has been formed, is discharged onto the discharge tray 23 by the discharge rollers 25.

Also, since the image forming portion 11 and the intermediate transfer belt 18 have a shorter life due to their nature than the image forming apparatus 1, the image forming portion 11 and the intermediate transfer belt 18 need to be replaced in order to fulfill the body life. Therefore, both the image forming portion 11 and the intermediate transfer belt 18 are made detachably attachable, thereby improving maintenance thereof.

A residual transfer toner remaining in the photosensitive drum 12 and the intermediate transfer belt 16 is recovered by a residual transfer toner recovering mechanism that is described later. The residual transfer toner of the photosensitive drum 12 is recovered by the drum cleaner 40, and the residual transfer toner of the intermediate transfer belt 16 is recovered by a belt cleaner 50.

Drum Cleaning and Intermediate Transfer Member Cleaning

Figure 2A:
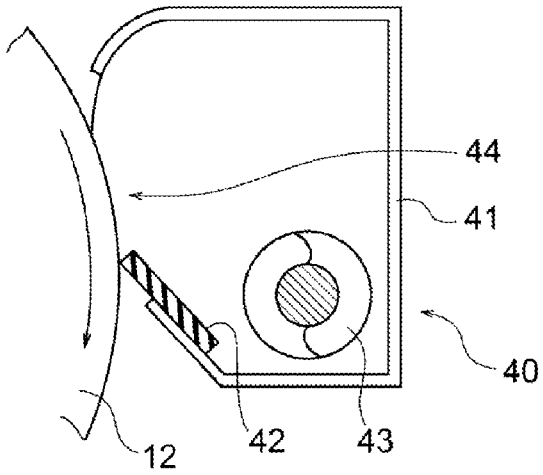
FIG. 2A is a cross-sectional view illustrating a configuration of a drum cleaner and an intermediate transfer cleaner.
Figure 2B:
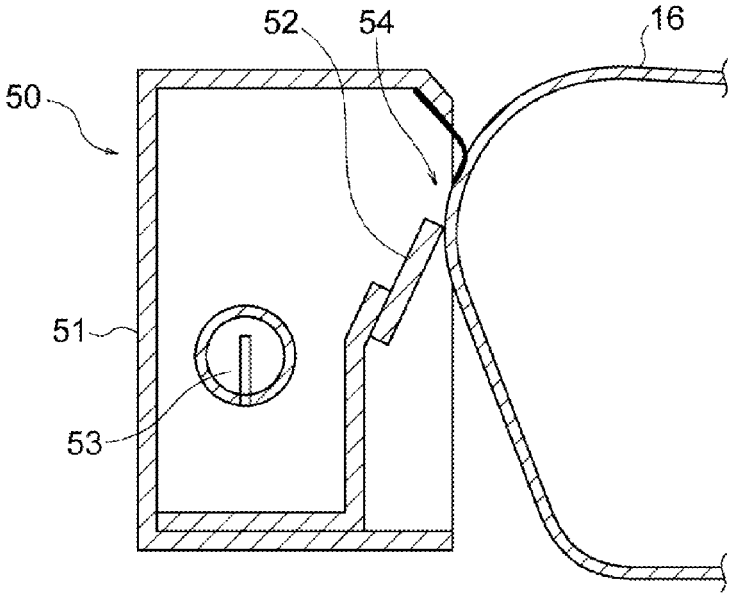
FIG. 2B is a cross-sectional view illustrating a configuration of a drum cleaner and an intermediate transfer cleaner.

A residual transfer toner cleaning configuration will be described with reference to FIG. 2. FIG. 2 is a cross-sectional view illustrating a configuration of a drum cleaner and an intermediate transfer cleaner. FIG. 2A illustrates a configuration of the drum cleaner 40, and FIG. 2B illustrates a configuration of the belt cleaner 50.

As illustrated in FIG. 2A, the drum cleaner 40 of this embodiment includes a drum cleaner container 41, a cleaning blade 42, and a toner conveying screw 43.

The cleaning blade 42 is disposed at an opening 44 of the drum cleaner container 41 such that the cleaning blade 42 faces the photosensitive drum 12. The cleaning blade 42 is an elastic blade with an edge portion abutting a surface of the rotating photosensitive drum 12 in a counter direction. Owing to this configuration, the residual transfer toner on the surface of the photosensitive drum 12 in the primary transfer is scraped off by the cleaning blade 42 and then recovered into the drum cleaner container 41.

The toner conveying screw 43 is disposed in a longitudinal direction at the bottom inside the drum cleaner container 41, and is driven to rotate by a driving portion (not illustrated). By the rotation of the toner conveying screw 43, the recovered toner is conveyed to a front side end of the drum cleaner container 41 (front side as viewed from the front of the image forming apparatus 1). A cylindrical toner discharge path 45 having an inside diameter substantially equal to the diameter of the toner conveying screw 43 (which will be described below) is provided at the front side end of the drum cleaner container 41.

As illustrated in FIG. 2B, the belt cleaner 50 includes a belt cleaner container 51, a cleaning blade 52, and a toner conveying screw 53.

The cleaning blade 52 is disposed at an opening 54 of the belt cleaner container 51 such that the cleaning blade 52 faces the intermediate transfer belt 16. The cleaning blade 52 is an elastic blade with an edge portion abutting a surface of the rotating intermediate transfer belt 16 in a counter direction. By this configuration, the residual transfer toner on the surface of the intermediate transfer belt 16 in the secondary transfer is scraped off by the cleaning blade 52 and then recovered into the belt cleaner container 51.

The toner conveying screw 53 is disposed in the longitudinal direction at the bottom inside the belt cleaner container 51, and is driven to rotate by a driving portion (not illustrated). By the rotation of the toner conveying screw 53, the recovered toner is conveyed to a front side end of the belt cleaner container 51. A cylindrical toner discharge path 55 having an inside diameter substantially equal to the diameter of the toner conveying screw 53 (which will be described later) is provided at the front side end of the belt cleaner container 51.

Toner Recovering Configuration

Figure 3:
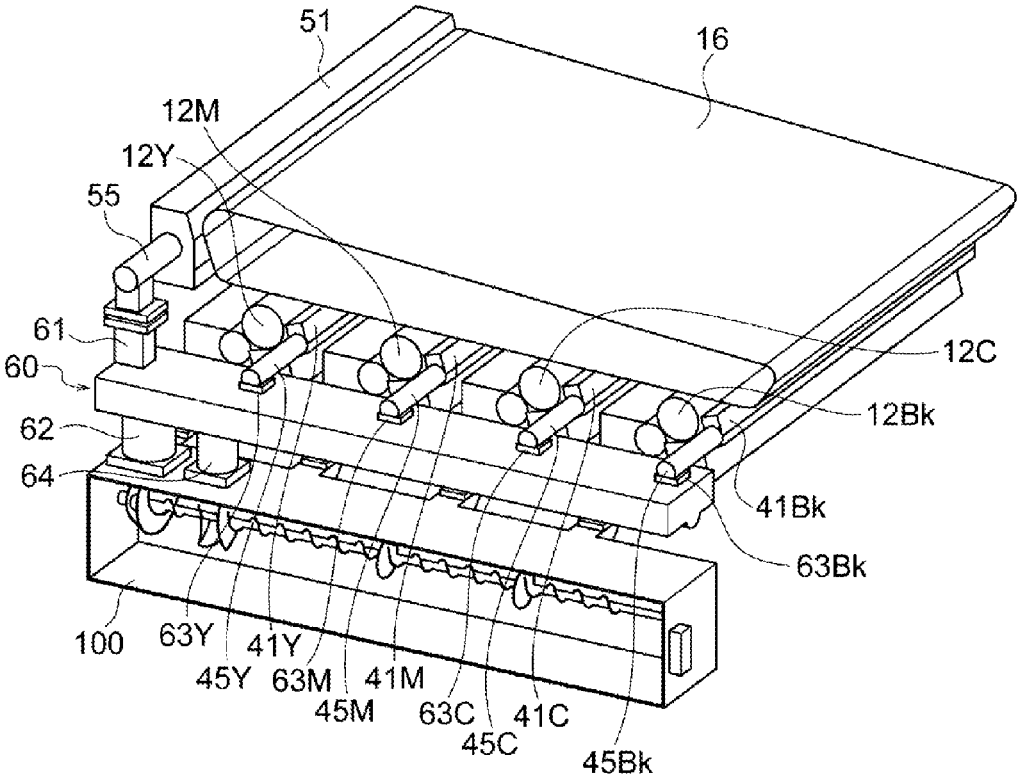
FIG. 3 is an overall perspective view illustrating a toner recovering configuration.

Next, a configuration for recovering a toner from the toner discharge path 45 and the toner discharge path 55 will be described. FIG. 3 is an overall perspective view of the toner recovering configuration. Incidentally, in the description, the respective members will be denoted by the signs "Y, M, C and K" representing the respective toner colors as necessary. For example, the drum cleaner 40 corresponding to yellow will be denoted by "40Y".

As illustrated in FIG. 3, cylindrical toner discharge paths 45 (45Y, 45M, 45C and 45Bk) protrude at front side ends of the respective drum cleaner containers 41 (41Y, 41M, 41C and 41Bk). The toner discharge path 45 has an inside diameter substantially equal to the diameter of the toner conveying screw 43 (see FIG. 2). Also, a cylindrical toner discharge path 55 is provided at the front side end of the belt cleaner container 51. The toner discharge path 55 has an inside diameter substantially equal to the diameter of the toner conveying screw 53 (see FIG. 2).

A recovery toner conveying path 60 extends under the four toner discharge paths 45 and the toner discharge path 55 in a direction crossing all of the four toner discharge paths 45 and the toner discharge path 55. Receiving ports 63 (63Y, 63M, 63C and 63Bk) are formed on the recovery toner conveying path 60 at positions corresponding to the front side ends of the toner discharge paths 45 (45Y, 45M, 45C and 45Bk). Also, a receiving port 61 is formed on the recovery toner conveying path 60 at a position corresponding to the front side end of the toner discharge path 55.

By this configuration, the recovered toners having discharged from the drum cleaner container 41 to the respective toner discharge paths 45 flow from the respective receiving ports 63 into the recovery toner conveying path 60. A conveying screw is arranged in the recovery toner conveying path 60, and a discharge port 64 is formed under a left side of the recovery toner conveying path 60. Therefore, the recovered toner having flown from the receiving port 63 into the recovery toner conveying path 60 is conveyed through the recovery toner conveying path 60 to flow from the discharge port 64 into a recovery toner container 100, and then is stored in the recovery toner container 100.

Likewise, the recovered toner having discharged from the belt cleaner container 51 to the toner discharge path 55 flows from the receiving port 61 into the recovery toner conveying path 60. A conveying screw is arranged in the recovery toner conveying path 60, and a discharge port 62 is formed under the recovery toner conveying path 60. Therefore, the recovered toner having flown from the receiving port 61 into the recovery toner conveying path 60 is conveyed through the recovery toner conveying path 60 to flow from the discharge port 62 into the recovery toner container 100, and then is stored in the recovery toner container 100.

Developing Portion

Figure 4A:
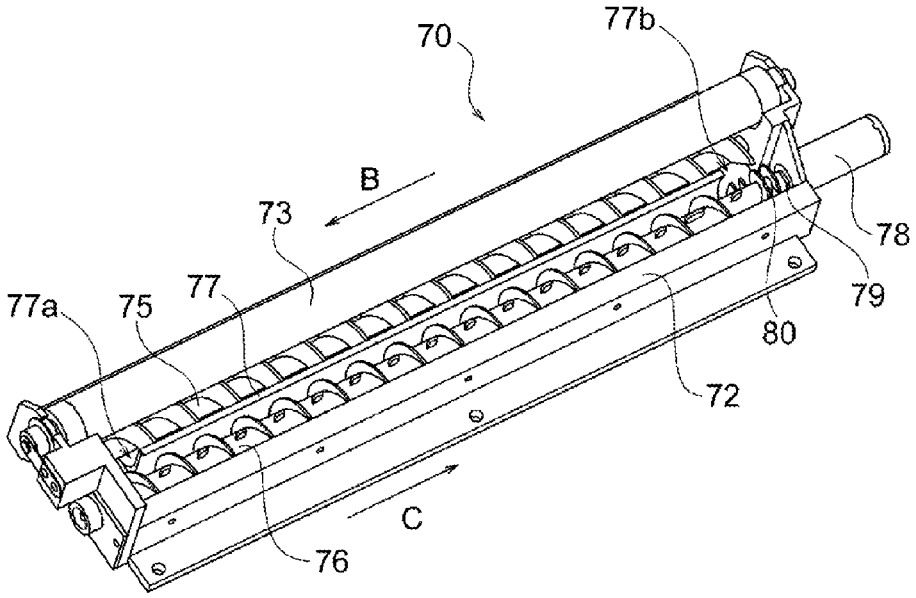
FIG. 4A is a diagram illustrating a configuration of a developing apparatus.
Figure 4B:
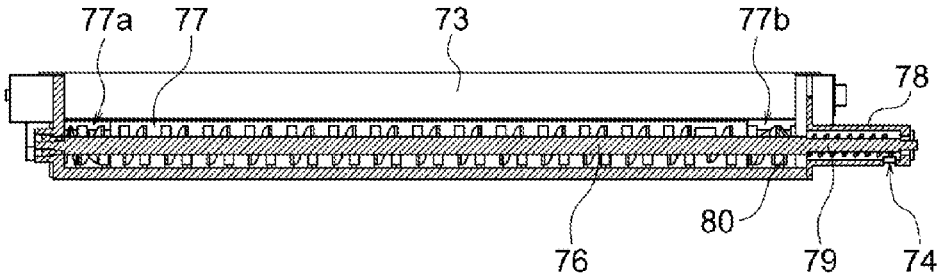
FIG. 4B is a diagram illustrating the configuration of the developing apparatus.

Next, a configuration of the developing portion 70, a toner conveying configuration thereof, and a relation thereof with the recovery toner conveying path 60 will be described in detail. FIG. 4 is a diagram illustrating the configuration of a developing apparatus. FIG. 4A is a perspective view, and FIG. 4B is a cross-sectional view. Since the four developing portions 70 of this embodiment are arranged to have the same configuration, the signs "Y, M, C and K" representing the respective colors will be omitted in the description of FIG. 4.

The developing portion 70 is a member that supplies a toner to the photosensitive drum 12 by a developing sleeve 73. As illustrated in FIG. 4A, in the developing portion 70, the inside of a developing container 72 as a housing is separated into two spaces by a partition wall 77 that extends in a longitudinal direction. Herein, the two spaces are not completely separated from each other, and a first opening 77*a* and a second opening 77*b* for delivering a developer between the two spaces are formed at both ends in the longitudinal direction.

A first agitating/conveying screw 75 is provided in the space near to the developing sleeve 73, and a second agitating/conveying screw 76 is provided in the space distant from the developing sleeve 73.

The first agitating/conveying screw 75 and the second agitating/conveying screw 76 are arranged in parallel to each other with the partition wall 77 interposed therebetween, and convey developers in opposite directions to each other. Accordingly, two-component developers contained in the developing container 72 are agitated/mixed, and are circulated/conveyed.

A developer discharge path 78 protrudes at the downstream side in the developer conveying direction of the second agitating/conveying screw 76. A developer discharge port 74 is formed under the downstream side end in the developer conveying direction of the developer discharge path 78. A developer discharge screw 79 is arranged in the developer discharge path 78, and conveys a developer from the developing container 72 to the developer discharge port 74.

A returning screw 80 is arranged between the second agitating/conveying screw 76 and the developer discharge screw 79. As illustrated in FIG. 4B, the returning screw 80 is coaxial with the second agitating/conveying screw 76 and the developer discharge screw 79, but is different in blade structure from the second agitating/conveying screw 76 and the developer discharge screw 79. That is, the returning screw 80 has a blade structure that returns a developer, which is conveyed to the second agitating/conveying screw 76, through the second opening 77*b* to the first agitating/conveying screw 75.

Therefore, when a developer amount in the developing container 72 is a normal amount, the developer returning from the second agitating/conveying screw 76 is delivered by the returning screw 80 to the first agitating/conveying screw 75. On the other hand, when developer replenishment increases, there is a case where the developer amount in the developing container 72 exceeds the normal amount. In this case, an excess developer gets over the returning screw 80 and is conveyed by the developer discharge screw 79 to the developer discharge port 74.

Herein, the developer replenishment will be described. In this embodiment, a two-component developer containing a predetermined ratio (about 10 wt %) of carrier in a toner is used as a replenishment developer, but the ratio is not limited thereto.

When the developer is consumed by image formation, a replenishment developer is replenished to maintain a constant toner density of the developer in the developing container 72. A replenishment amount of the replenishment developer is determined by a toner replenishment amount controller. The toner replenishment amount controller is approximately determined based on a rotation speed of a replenishing screw.

The replenishment developer is replenished from a replenishment developer hopper 15 (see FIG. 1) to the developing portion 70. The replenishment developer flows into the developing container 72 from an opening (not illustrated) that is formed over an upstream side of the second agitating/conveying screw 76 of the developing container 72.

When the replenishment is performed, the amount of the developer in the developing container 72 increases. Since the replenishment developer contains a 90% toner and a 10% carrier, the toner is consumed by image formation but the carrier is not consumed. Then, the carrier remains in the developing container 72, and the developer amount increases when the replenishment is repeated. Therefore, when the developer amount increases, an excess developer gets over the returning screw 80, so that a developer is discharged from the developing container 72. The developer discharged from the developing container 72 is conveyed to the recovery toner container 100 through the following process.

Delivery to Recovery Toner Container

Next, a developer delivery being a characteristic configuration of this embodiment will be described. In this embodiment, a delivery from the developing container 72 to the recovery toner container 100 will be described as an example. All from the developing container 72 (upstream side unit) to the recovery toner container 100 (downstream side unit) are detachably attachable to the image forming apparatus 1.

Figure 5:
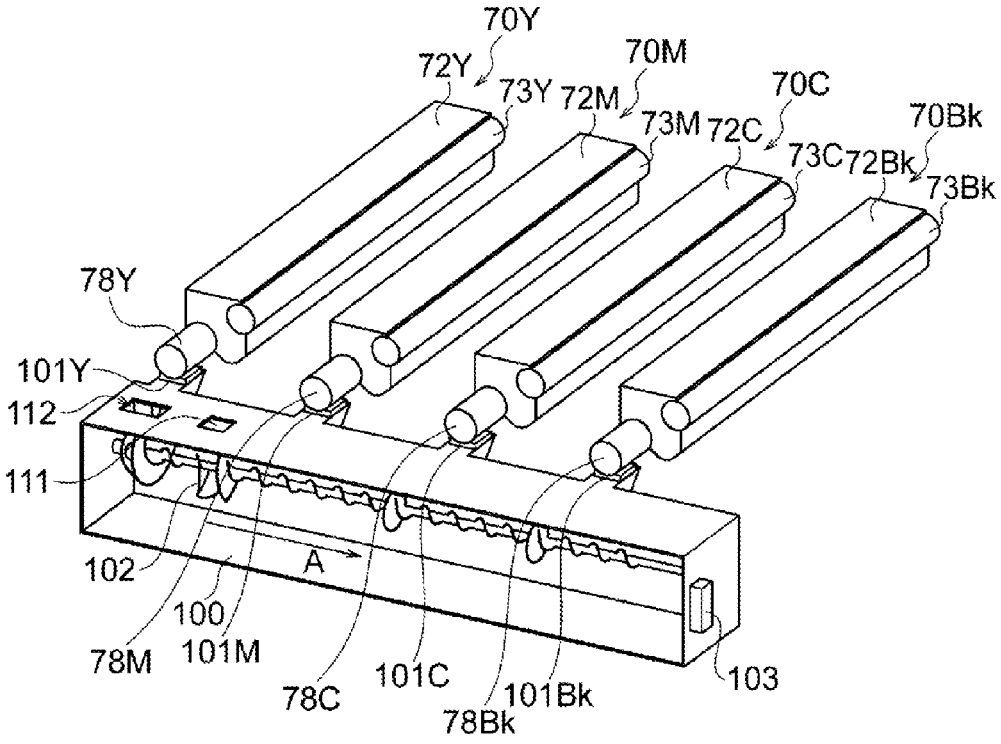
FIG. 5 is a perspective view describing a developer delivery from a developing container to a recovery toner container.

FIG. 5 is a perspective view describing a developer delivery from the developing container to the recovery toner container. In FIG. 5, although the signs "Y, M, C and K" representing the respective colors are added, configurations such as the developing portions 70 are the same regardless of the colors of toner images formed. Therefore, the signs representing the respective colors will be omitted in the following description.

As illustrated in FIG. 5, a developer discharge path 78 protrudes at a front side end of the developing container 72. The recovery toner container 100 is disposed under a front side of the developer discharge path 78, and receives the developer discharged from the developer discharge path 78. A toner delivery from the developer discharge path 78 to the recovery toner container 100 is performed through a developer receiving port 101 protruding at an inner side from the recovery toner container 100. Accordingly, the developer discharged from the developing container 72 of the developing portion 70 flows into the recovery toner container 100.

The developer having flown into the recovery toner container 100 is conveyed in a direction of arrow A by a screw 102 arranged in the recovery toner container 100. Accordingly, a top surface of the developer in the recovery toner container 100 is leveled.

A toner recovering port 111 and a toner recovering port 112 are formed at a top surface of the recovery toner container 100. The toner recovering port 111 recovers the toner from the drum cleaner 40, and the toner recovering port 112 recovers the toner from the belt cleaner 50. The toner from the discharge port 64 (see FIG. 3) flows into the toner recovering port 111, and the toner from the discharge port 62 (see FIG. 3) flows into the toner recovering port 112. In this manner, the toner from the drum cleaner 40 and the belt cleaner 50 and the developer from the developing portion 70 are recovered in the recovery toner container 100.

A recovery amount detecting sensor 103 is arranged at an end surface of the recovery toner container 100. The recovery amount detecting sensor 103 detects that the toner and developer recovered into the recovery toner container 100 exceeds a predetermined amount. Then, a CPU (controller) of the image forming apparatus 1 receives a detection signal thereof and displays the detection signal on a display (display portion) arranged at the apparatus. Accordingly, a user can know that the total amount of the toner and developer in the recovery toner container 100 has reached an allowable amount that can be recovered.

Figure 6A:
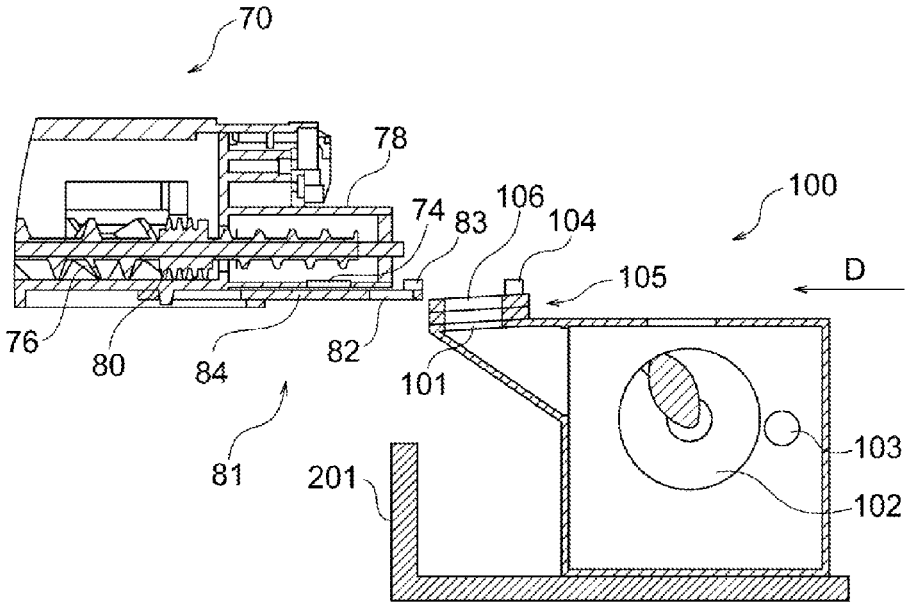
FIG. 6A is a cross-sectional view illustrating a process of communicating a developer receiving port of the recovery toner container and a developer discharge port of a developing portion with each other.
Figure 6B:
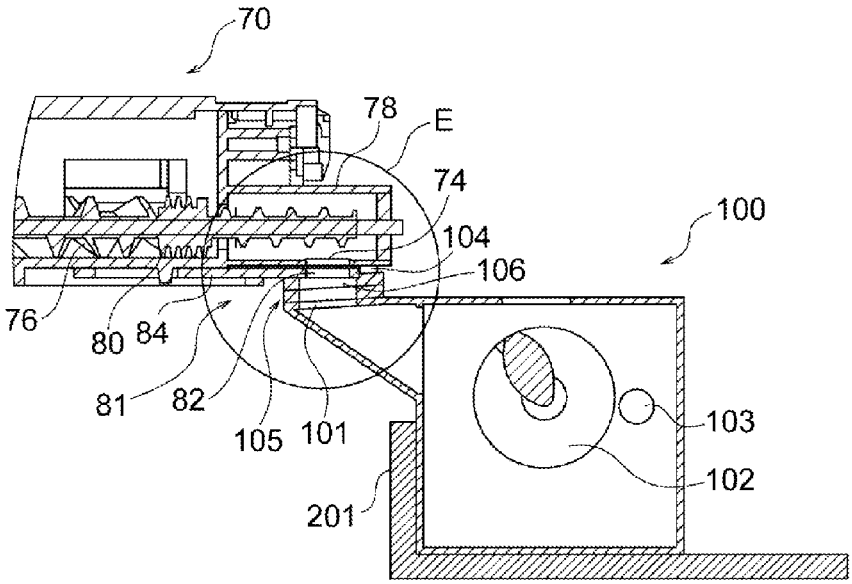
FIG. 6B is a cross-sectional view illustrating a process of communicating a developer receiving port of the recovery toner container and a developer discharge port of a developing portion with each other.

Next, a detailed description will be given of the relation between the developer discharge path 78 of each developing portion 70 and the developer receiving port 101 of the recovery toner container 100 when the image forming apparatus 1 is provided with the recovery toner container 100. FIG. 6 is a cross-sectional view illustrating a process of communicating the developer receiving port of the recovery toner container and the developer discharge port of the developing portion with each other. FIG. 6A illustrates a state before the developer discharge port and the developer receiving port are communicated with each other, and FIG. 6B illustrates a state where the developer discharge port and the developer receiving port are communicated with each other.

As illustrated in FIG. 6A, when the recovery toner container 100 is disposed at a predetermined position of the body, the recovery toner container 100 is placed on a support 201 configured in the image forming apparatus 1 and is slid in a direction of arrow D.

A hollow sealing member 105 is attached on the developer receiving port 101 of the recovery toner container 100. In the sealing member 105, an opening 106 for inflow of a developer is formed, and a pressing protrusion 104 adjacent to the opening 106 is fixed at an apparatus front side (right side in the drawing) than the opening 106.

Also, a shutter 81 (shielding member) sliding in parallel to a protrusion direction of the developer discharge path 78 is provided under the developer discharge path 78 of the developing container 72 in the developing portion 70. The shutter 81 includes a shutter opening 82 (opening) through which a developer passes, a protrusion 83 arranged outer than the shutter opening 82, and a shielding portion 84 for shielding the developer discharge port 74. Since the shutter 81 is biased to the right side of FIG. 6A by a biasing mechanism such as a spring (not illustrated), the developer discharge port 74 and the shutter opening 82 are not communicated with each other under normal conditions.

By this configuration, before the attachment of the recovery toner container 100, as illustrated in FIG. 6A, the shutter 81 is biased to the right side of FIG. 6A, so that the developer discharge port 74 of the developer discharge path 78 is blocked to the outside.

Herein, when the recovery toner container 100 is installed on the support 201 and moves to the left side of FIG. 6A (in the direction of arrow D), the pressing protrusion 104 fixed to the sealing member 105 also moves to the left side of FIG. 6A and presses the protrusion 83. Accordingly, the shutter 81 moves to the left side of FIG. 6A, and the shutter opening 82 of the shutter 81 is communicated with the developer discharge port 74 as illustrated in FIG. 6B.

In this state, since the sealing member 105 moves under the developer discharge path 78, the developer discharge port 74 and the shutter opening 82 are communicated with each other and also the opening 106 of the sealing member 105 and the developer receiving port 101 are communicated with each other. By this configuration, the developer can be delivered from the developer discharge path 78 to the recovery toner container 100.

Figure 7:
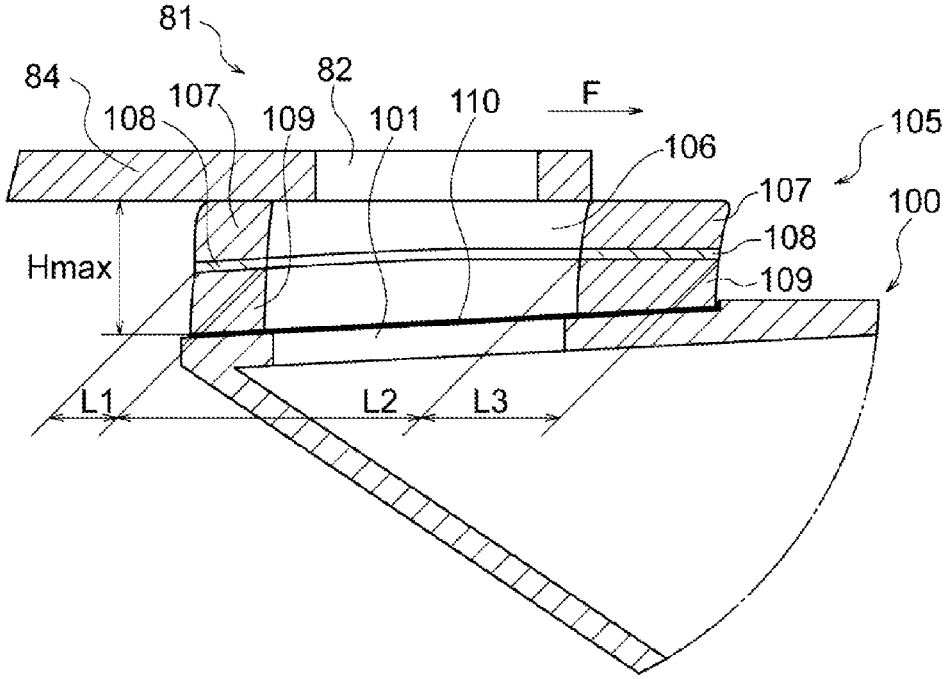
FIG. 7 is an enlarged view of a portion represented by E of FIG. 6B.
Figure 8:
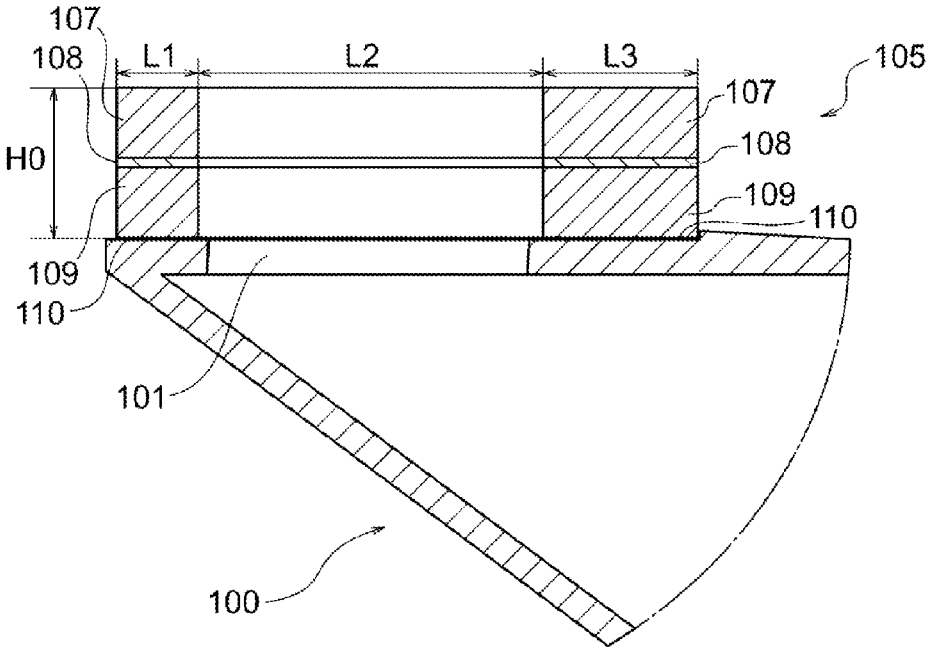
FIG. 8 is a cross-sectional view illustrating a natural state of a sealing portion of the recovery toner container.

Next, a detailed description will be given of a process in which the shutter 81 of the developer discharge path 78 and the sealing member 105 of the recovery toner container 100 are communicated with each other. FIG. 7 is an enlarged view of a portion represented by E of FIG. 6B. FIG. 8 is a cross-sectional view illustrating a natural state of a sealing portion of the recovery toner container.

The sealing member 105 includes an upper elastic member 107 and a lower elastic member 109 formed of a foam material such as a sponge, and a sheet material 108 formed of a sheet-like film such as a resin and nipped between the upper elastic member 107 and the lower elastic member 109. The upper elastic member 107, the sheet material 108, and the lower elastic member 109 are stacked in this order and are adhered to each other to be integrated into one. A bottom surface of the lower elastic member 109 is adhered to a top surface of the recovery toner container 100 by a double-sided tape 110.

Since the upper elastic member 107 and the lower elastic member 109 of the sealing member 105 have elasticity, the sealing member 105 is compressed in the process of moving the recovery toner container 100 to a predetermined position. That is, the maximum gap Hmax between a bottom surface of the shutter 81 and the top surface of the recovery toner container 100 illustrated in FIG. 7 becomes smaller than a normal-state height HO of the sealing member 105 illustrated in FIG. 8. In this manner, when the sealing member 105 is compressed in a height direction, the bottom surface of the shutter 81 and a top surface of the sealing member 105 are closely adhered to each other. Therefore, without scattering the developer from the shutter opening 82, the developer receiving port 101 of the recovery toner container 100 can be installed at the bottom surface of the shutter 81 of the developing portion 70.

Also, as described above, the upper elastic member 107 and the lower elastic member 109 can be deformed in both the vertical direction and the horizontal direction. On the other hand, the sheet material 108 between the upper elastic member 107 and the lower elastic member 109 is formed of a material that is not deformed in both the vertical direction and the horizontal direction.

As illustrated in FIG. 7, when a frictional force acts between the sealing member 105 and the bottom surface of the shutter 81, the top portion of the sealing member 105 is subjected to a deformation force in a direction of arrow F. However, since the sheet material 108 is formed of a material that is not deformed, lengths of cross sections of the sealing member 105 illustrated in FIGS. 7 and 8 maintain constant lengths of L1, L2 and L3. Here, L1, L2 and L3 are horizontal lengths of regions of the sheet material 108 adhered to the lower elastic member 109.

In this manner, by suppressing a horizontal deformation of the entire sealing member 105, the sealing member 105 of the recovery toner container 100 can be smoothly inserted into the bottom surface of the shutter 81 of the developing portion 70, and thus the scattering of the developer can be further suppressed.

Comparative Example

Figure 10:
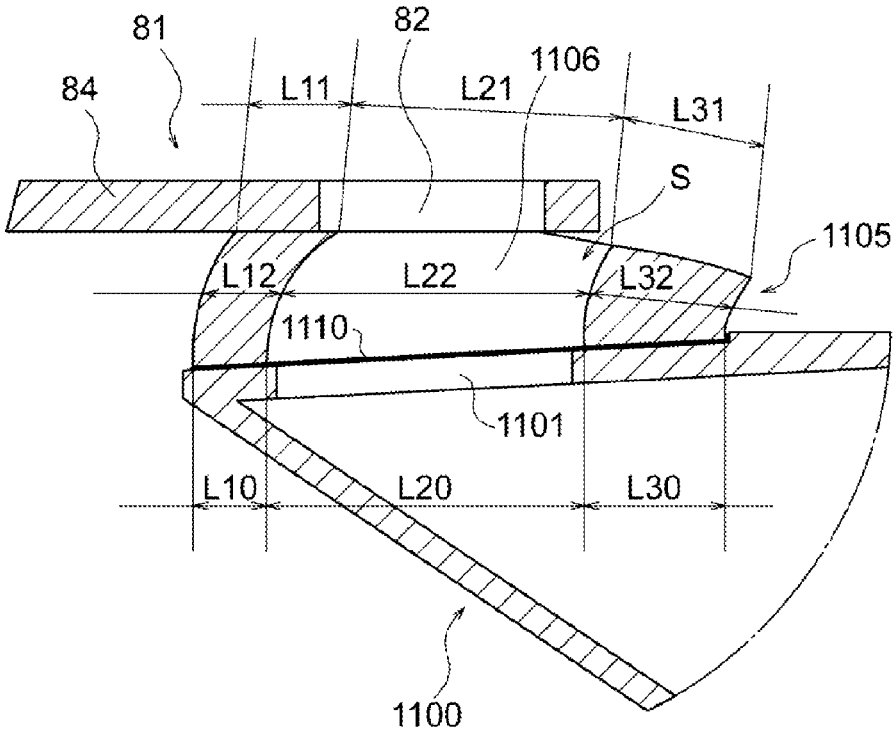
FIG. 10 PRIOR ART
FIG. 10 is a cross-sectional view illustrating a sealing member of a conventional recovery toner container.

The deformation of the sealing member 105 of this embodiment will be described in comparison with that of the conventional configuration. FIG. 10 is a cross-sectional view illustrating a sealing member of a conventional recovery toner container.

A conventional sealing member 1105 is entirely formed of a foam material being an elastic body, and is adhered to a recovery toner container 1100 by a double-sided tape 1110. Since a portion adhered to the recovery toner container 1100 is not deformed, lengths L10, L20 and L30 of cross sections in a bottom portion of the sealing member 1105 of the adhesion portion do not change.

However, the sealing member 1105 is an elastic body and is deformed freely. Therefore, lengths L11, L21 and L31 of cross sections in a center portion of the sealing member 1105, or lengths L12, L22 and L32 of cross sections in a top portion thereof are different from the lengths L10, L20 and L30 of cross sections in the bottom portion thereof. In this case, since the recovery toner container is horizontally adhered to the developing portion, a deformation of the sealing member 1105 is large in a lateral direction (horizontal direction) and is small in a longitudinal direction (vertical direction).

Since the shape of the periphery of an opening 1106 formed in the sealing member 1105 deforms freely, the shape of the opening 1106 also deforms. Then, as illustrated in FIG. 10, when the developer from the shutter opening 82 of the shutter 81 flows into the opening 1106, a gap S causing a leakage from the opening 1106 to the outside is generated. That is, the sealing performance of the sealing member 1105 is degraded.

On the other hand, in this embodiment, the sheet material 108 is interposed between the upper elastic member 107 and the lower elastic member 109, so that a deformation in the horizontal direction can be suppressed from the viewpoint of the entire sealing member 105. Since the sheet material 108 is thin, a vertical compressive deformation of the upper elastic member 107 and the lower elastic member 109 is not suppressed.

In this manner, in this embodiment, when the recovery toner container 100 is mounted, a horizontal deformation of the sealing member 105 is suppressed but a vertical compressive deformation is sufficiently generated. Accordingly, it is possible to prevent a developer leakage gap from being formed between the shutter opening 82 of the shutter 81 and the opening 106 of the sealing member 105.

Also, the sealing member 105 has a simple configuration in which the sheet material 108 is inserted between the upper elastic member 107 and the lower elastic member 109. As a result, the deformation of the sealing member in the unit detachment/attachment can be suppressed by a simple configuration, the scattering of the developer in the delivery of the developer can be prevented, and the toner leakage in a toner delivering portion can be prevented.

Second Embodiment

Figure 9A:
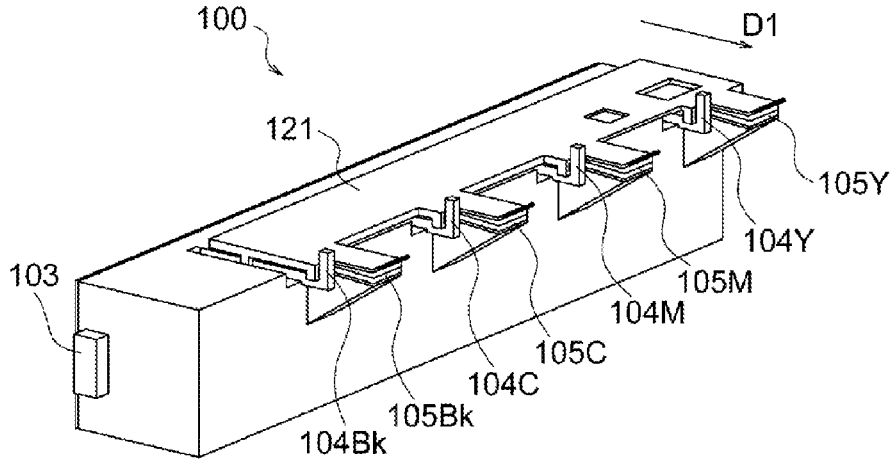
FIG. 9A is a perspective view of a recovery toner container according to a second embodiment.
Figure 9B:
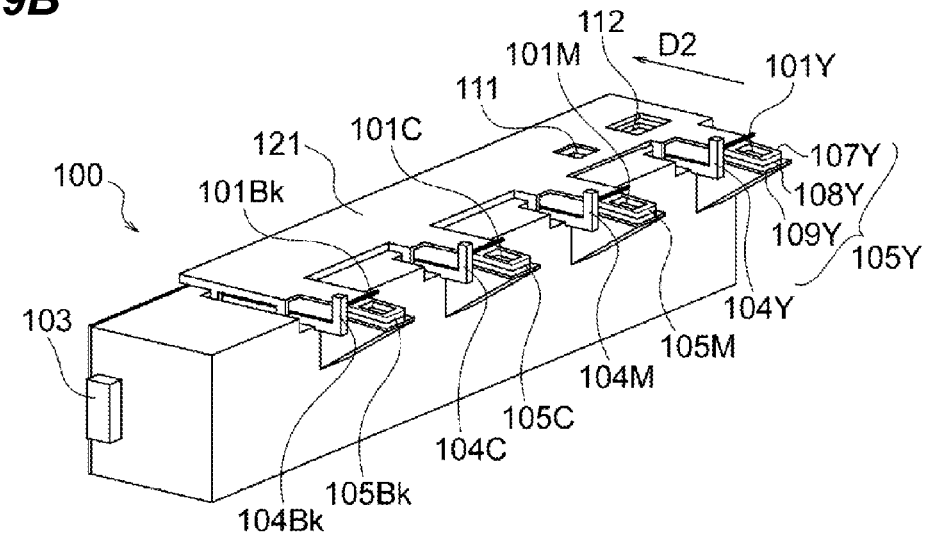
FIG. 9B is a perspective view of the recovery toner container according to the second embodiment.

A second embodiment of the present invention will be described with reference to the drawings. FIG. 9 is a perspective view of a recovery toner container according to the second embodiment. FIG. 9A illustrates a state where a shutter is closed, and FIG. 9B illustrates a state where the shutter is opened. The same configuration as in the above-described embodiment is denoted by the same reference numeral, and a description thereof will be omitted.

When a predetermined amount of toner is recovered into the recovery toner container 100, the recovery amount detecting sensor 103 detects that the recovery toner container 100 is filled with a toner and a developer. Herein, the recovery toner container 100 is replaced by the user.

Herein, as illustrated in FIG. 9, a shutter 121 is arranged at a top portion of a recovery toner container 100 of this embodiment. When the recovery toner container 100 is removed from the image forming apparatus 1, the shutter 121 slides in a direction of arrow D1 of FIG. 9A to block a developer receiving port 101, a toner recovering port 111, and a toner recovering port 112. Accordingly, a developer is not spilled from the developer receiving port 101, the toner recovering port 111, and the toner recovering port 112.

On the other hand, when the recovery toner container 100 is attached to the body of the image forming apparatus 1, the shutter 121 slides in a direction of arrow D2 of FIG. 9B to open the developer receiving port 101, the toner recovering port 111, and the toner recovering port 112 that are formed on the recovery toner container 100.

A sealing member 105 is adhered to a top portion of each developer receiving port 101 by a double-sided tape 110 (see FIG. 8) to fill a gap with respect to the developer discharge port 74 of a developing container 72.

Herein, as illustrated in FIG. 9B, the sealing member 105 includes an upper elastic member 107, a sheet material 108, and a lower elastic member 109 that are stacked and adhered together. Then, even when the recovery toner container 100 includes the shutter 121 as in this embodiment, the horizontal deformation of the sealing member 105 is suppressed but a vertical compressive deformation is sufficiently generated.

As described above, the scattering of the developer can be prevented even when the recovery toner container 100 includes the shutter 121.

Other Embodiments

In the above-described embodiments, it has been illustrated that the sealing member 105 is formed at the recovery toner container 100, but the present invention is not limited thereto. For example, the sealing member 105 may be provided at the developer discharge port 74 of the developing container 72 or the shutter opening 82.

In the above-embodiments, the sealing configuration of the toner delivering portion between the development device and the recovery toner container and the configuration of the recovery toner container and the shutter has been described, but the present invention is not limited thereto. For example, it may be applied to the sealing of all the toner delivering portions such as the discharge portion of the drum cleaner, the discharge portion of the intermediate transfer cleaning, and the delivering portion between the hopper and the development device.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A toner recovery container, which is detachably provided in an image forming apparatus body, the toner recovery container comprising:

a receiving port that receives toner; and a sealing portion configure to seal the periphery of the receiving port, wherein the sealing portion is configured to be compressed between the image forming apparatus body and the toner recovery container, and wherein the sealing portion includes:

a first elastic layer that is compressively deformable;

a second elastic layer that is compressively deformable; and a sheet-shaped resin layer that is disposed between the first elastic layer and the second elastic layer with respect to a sealing compression direction that the sealing portion is compressed when the recovery container is attached to the image forming apparatus body.

2. The toner recovery container according to claim 1, wherein the toner recovery container is detachably provided to the image forming apparatus body by sliding in a direction that intersects with the sealing compression direction.

3. The toner recovery container according to claim 1, wherein the first and second elastic layers are a foam material, and the resin layer is a material that is not substantially compressively deformed when the sealing portion is compressed.

4. The toner recovery container according to claim 1, wherein the resin layer is formed of a film.

5. A sealing member, which seals a periphery of a connection portion connected to a toner recovery container that is detachably provided in an image forming apparatus body, the sealing member comprising:

a first elastic layer that is compressively deformable;

a second elastic layer that is compressively deformable; and a sheet-shaped resin layer that is disposed between the first elastic layer and the second elastic layer with respect to a sealing compression direction that the sealing member is compressed when the recovery container is attached to the image forming apparatus body.

6. The sealing member according to claim 5, wherein the toner recovery container is detachably provided to the image forming apparatus body by sliding in a direction that intersects with the sealing compression direction.

7. The sealing member according to claim 5, wherein the first and second elastic layers are a foam material, and the resin layer is a material that is not substantially compressively deformed when the sealing portion is compressed.

8. The sealing member according to claim 5, wherein the resin layer is formed of a film.

9. An image forming apparatus comprising:

a toner recovery container that includes a receiving port receiving toner and is detachably provided in an apparatus body; and a sealing portion that is compressively deformed between the toner recovery container and the apparatus body to seal a periphery of the receiving port, wherein the sealing portion includes:

a first elastic layer that is compressively deformable;

a second elastic layer that is compressively deformable; and a sheet-shaped resin layer that is disposed between the first elastic layer and the second elastic layer with respect to a sealing compression direction that the sealing portion is compressed when the recovery container is attached to the apparatus body.

10. The image forming apparatus according to claim 9, wherein the toner recovery container is detachably provided to the apparatus body by sliding in a direction that intersects with the sealing compression direction.

11. The image forming apparatus according to claim 9, wherein the first and second elastic layers are a foam material, and the resin layer is a material that is not substantially compressively deformed when the sealing portion is compressed.

12. The image forming apparatus according to claim 9, wherein the resin layer is formed of a film.

* * * * *